US005404634A

United States Patent [19]

Takeshita et al.

[11] Patent Number: 5,404,634

[45] Date of Patent: Apr. 11, 1995

[54] WIRE ENDS PROCESSING APPARATUS

[75] Inventors: Kazutoshi Takeshita; Tatsuya Maeda; Masahiro Oishi; Hideyuki Kaneda; Yoshio Shimizu; Osamu Murata, all of Shizuoka, Japan

[73] Assignee: Yazaki Corporation, Tokyo, Japan

[21] Appl. No.: 235,329

[22] Filed: Apr. 29, 1994

[30] Foreign Application Priority Data

Apr. 30, 1993 [JP] Japan ..... 5-103996

[51] Int. Cl.[6] ..... H01R 43/00

[52] U.S. Cl. ..... 29/564.4; 29/33 M; 29/564.6; 29/755

[58] Field of Search ..... 29/564.4, 564.2, 564.6, 29/564.1, 33 M, 33 P, 755, 748

[56] References Cited

U.S. PATENT DOCUMENTS 4,375,229 3/1983 Mikami et al. .
4,554,725 11/1985 Over et al. ..... 29/564.4
4,581,796 4/1986 Fukuda et al. ..... 29/33 M
4,631,822 12/1986 Reinertz ..... 29/564.6 X
4,641,428 2/1987 Anderson ..... 29/564.4 X

FOREIGN PATENT DOCUMENTS 65-5424 1/1994 Japan .

*Primary Examiner*—William Briggs
*Attorney, Agent, or Firm*—Armstrong, Westerman, Hattori, McLeland & Naughton

[57] ABSTRACT

In an apparatus that prepares wires necessary for electric wiring by measuring and cutting a length of a wire fed from a wire paying-out device, conveying the cut length of wire in a direction perpendicular to the axial direction of the paid-out wire, stripping wire end portions, and pressing an electrical connector by a connector pressing device, the present invention provides a configuration in which the apparatus can selectively comprise a connector pressing unit composed of a connector pressing device and a pedestal for supporting it on a platform next to the location of the above stripping device, whereby it will facilitate production on many-kinds-and-small-amounts basis as it needs no programming time or adjustment for the replacement of lots.

4 Claims, 7 Drawing Sheets

WIRE ENDS PROCESSING APPARATUS

BACKGROUND OF THE INVENTION

1. Field of the Invention

The present invention relates to an improvement in a wire ends processing apparatus to prepare wires necessary for electric wiring by cutting off a predetermined length of a wire fed from a wire paying-out device, conveying the cut length of wire in a direction perpendicular to the axial direction of the paid-out wire and subjecting the wire end portions to various kinds of processing such as stripping of the wire ends and attachment of connectors.

2. Description of the Prior Art

A conventional wire ends processing apparatus is illustrated in a perspective view shown in FIG. 7.

In the figure, the apparatus 2 generally includes a wire feed device 3, a reversing device 4, a cutting device 5, a conveyer device 6, a stripping device 7, a sensor 8, a connector pressing device 9 and another sensor 10. The apparatus 2 further includes an automatic control device 1 for controlling these devices automatically, a platform 11 on which the respective devices are mounted and a table 12 for supporting the wires carried in a hair-pin form by the conveyer device 6 (Japanese Patent Laid-Open Number 64-5424), wherein each assembly of the wire ends processing apparatus 2 is operated by an output signal of the control device 1 which is based on information carried on a magnetic tape or like storage means of the control device.

The function of each of the wire ends processing apparatus 2 is explained as below.

A wire feed device 3 is adapted to pay out a wire W from a reel (not shown) by a predetermined distance and feed the thus paid-out wire W to a reversing device 4. The reversing device 4 is adapted to clamp an end portion of the wire W and rotate along the paid-out direction of wire so as to reverse in a hair-pin configuration. The cutting device 5 cuts off a predetermined length of the wire fed in relation with the action of the wire feed device 3 and the reversing device 4. The conveyer device 6 functions to transfer the wire cut off by the cutting device 5 to any of various devices for processing the ends of the wire such as to the stripping device 7, the sensor 8, and to a connector pressing device 9 by a gripper 14 provided on an endless chain 13, wherein the stripping device 7 removes the insulating cover from each end portion of the wire brought thereto by the conveyer device 6, and the sensor 8 determines whether or not the uncovered condition of the wire is acceptable. Each of the connector pressing devices 9 is adapted to press and clamp an electric connector member onto a naked conductor portion of the wire, and the sensor 10 judges the clamped condition of the connector on the wire.

In summary, a wire ends processing apparatus as constructed above comprises the steps of causing clamp pawls provided to a reversing device 4 to grip an end portion of a wire W fed by a wire feed device 3, turning the wire round by the reversing device 4 in a direction opposite to the wire fed direction, paying out, by a desired distance, the wire W on the side opposite to one gripped by the clamp pawls and cutting the wire, then stripping the insulating cover of one end of the wire by the stripping device 7, and finally pressing and clamping an electric connector member onto a naked conductor portion of the wire by the connector pressing device 9.

By the way, a current trend in the art of wire harness production is going rather to a small-amount, many-kind production system than to a simple system based on quantity alone. In this connection, there is an increasing demand for an apparatus which, using a single wire processing device, performs, for example, clamping and pressing of different kinds of electric connectors on various standards (of diameter, form, color of insulating cover etc.) and length of wires.

However, a replacement of one type of electric connector with another type in the connector pressing device 9 of the above apparatus 2 requires first removal of an applicator **9*a*, which is composed of a pressing mold and a connector feeding assembly and is exclusively used to one type of electric connector, from the connector pressing device 9 fixed to the apparatus 2, and further requires, after a new electric connector is installed to a newly provided applicator 9*a*, an adjustment of the crimping height, which consumes a substantially long time. Moreover, since the apparatus 2** cannot be activated as a whole during such replacing operation, if the steps of these procedures are increased, an efficiency of the production is substantially lowered.

In addition, a wire for a water-proof connector, as shown in FIG. 8, needs being provided with a rubber plug 15 thereto before the connector pressing operation, and in this case, a rubber plug inserter can be disposed between the cutting device 5 and the stripping device 7 as a normal procedure. However, since rubber plugs to be installed also differ in accordance with the standard of wire or size of the connector housing in which they are to be inserted, installation of a rubber plug inserter or the replacement thereof equally takes time just like the case of the connector pressing device.

SUMMARY OF THE INVENTION

The present invention has been made to eliminate such problems as described, and it is a first object of the present invention to provide a wire ends processing apparatus which promotes high-speed and specific operations on wires such as measurement, cutting-off, stripping, clamping and achieve many-kind, small-amount production by shortening a programming time for a lot change while eliminating mechanical adjustment caused by the programming. The second object of the present invention is to provide an apparatus which is capable of also installing simultaneously a rubber plug exclusively used for one type of electric connector by a connector pressing device during replacement or settlement of the connector pressing device.

In order to achieve the first object, in an apparatus that prepares wires necessary for electric wiring by measuring and cutting a length of a wire fed from a wire paying-out device, conveying the cut length of wire in a direction perpendicular to the axial direction of the paid-out wire, stripping wire end portions, and pressing an electrical connector by a connector pressing device, the present invention according to the first aspect provides a configuration in which the apparatus can selectively comprise a connector pressing unit composed of a connector pressing device and a pedestal for supporting it on a platform next to the location of the above stripping device.

In order to achieve the second object, in an apparatus that prepares wires necessary for electric wiring by measuring and cutting a length of a wire fed from a wire paying-out device, conveying the cut length of wire in a direction perpendicular to the axial direction of the paid-out wire, stripping wire end portions, the present invention according to the second aspect provides a configuration in which the apparatus can selectively comprise, next to the location of the cutting device on a platform, a composite unit composed of a rubber plug inserter with respect to the wire, an insulating cover stripping device, a connector pressing device for pressing an electrical connector and a pedestal for supporting it.

In the construction according to the first aspect, since a connector pressing unit composed of a connector pressing device and a pedestal for supporting it can be selectively disposed on a platform next to the location of the above stripping device, if a preadjusted connector pressing unit is prepared in advance, it will facilitate production on many-kinds-and-small-amounts basis because it needs no programming time or adjustment for the replacement of lots.

Also, in the configuration according to the second aspect, since a rubber plug inserter with respect to the wire, an insulating coat stripping device, a connector pressing device for pressing an electrical connector and a pedestal for supporting it are formed into one composite unit, the installation of the rubber plug exclusively used for one type of electric connector and to be pressed by the connector pressing device can be settled concurrently with the settlement of the composite unit, whereby it can cope speedily with a current trend of a small-amount, many-kind production system.

Other objects and features of the invention will now be more fully understood from the following detailed description and appended claims when taken with the accompanying drawings.

DETAILED DESCRIPTION OF THE PREFERRED EMBODIMENTS

In the following, one embodiment of the present invention will now be described with reference to the accompanying drawings.

Figure 1:
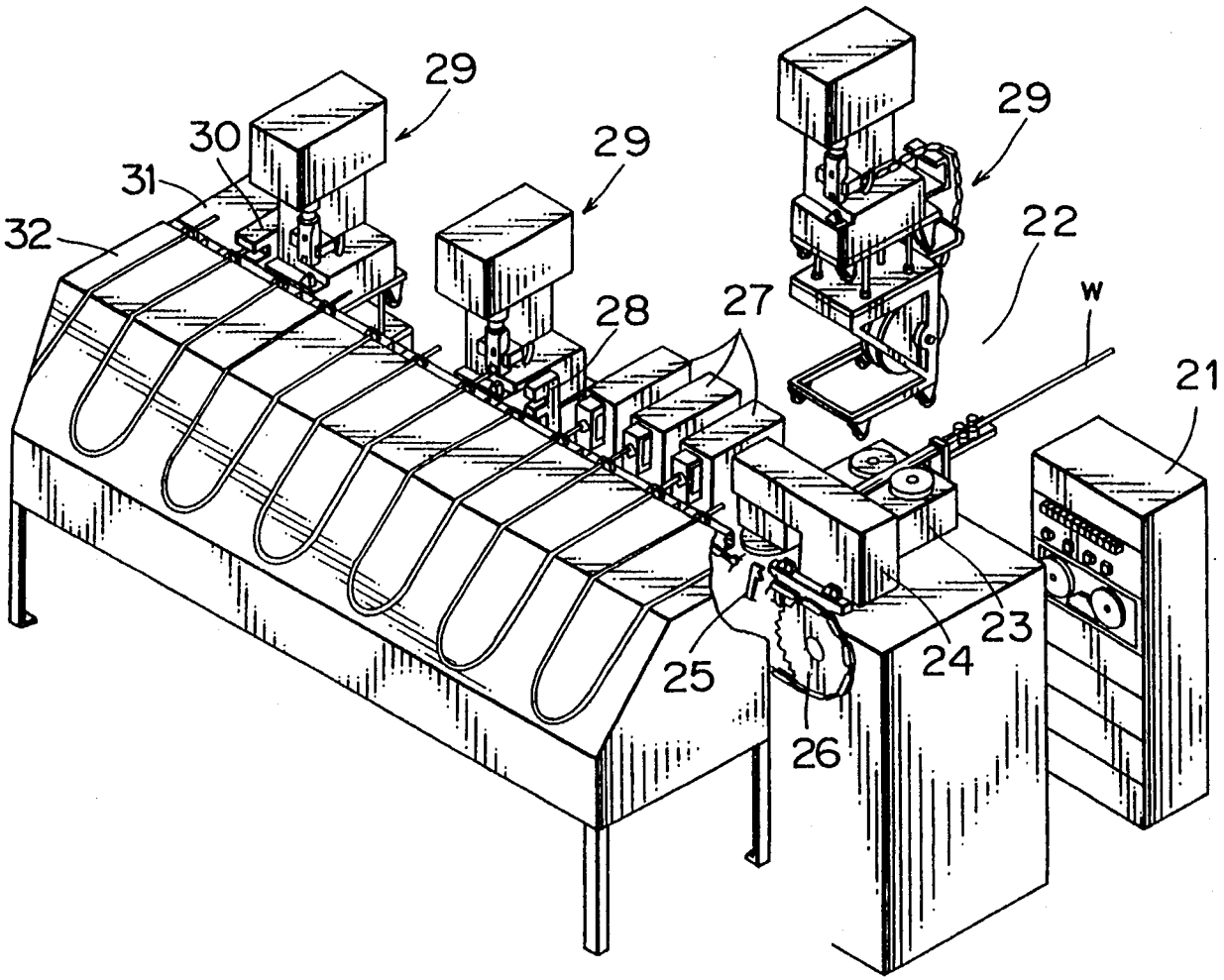
FIG. 1 is a general perspective view of a wire end processing apparatus provided with a connector pressing unit according to a first aspect of the present invention.

FIG. 1 is a general perspective view showing one embodiment of a wire end processing apparatus of the present invention, wherein the wire end processing apparatus 22 is composed of a wire feed device 23, a reversing device 24, a cutting device 25, a conveyer device 26, a stripping device 27, a sensor 28, a connector pressing unit 29, another sensor 30, an automatic control device 21 for controlling these devices, a platform 31 on which the respective devices are mounted and a table 32 for supporting the wires carried in a hair-pin form by the conveyer device 26.

Figure 7:
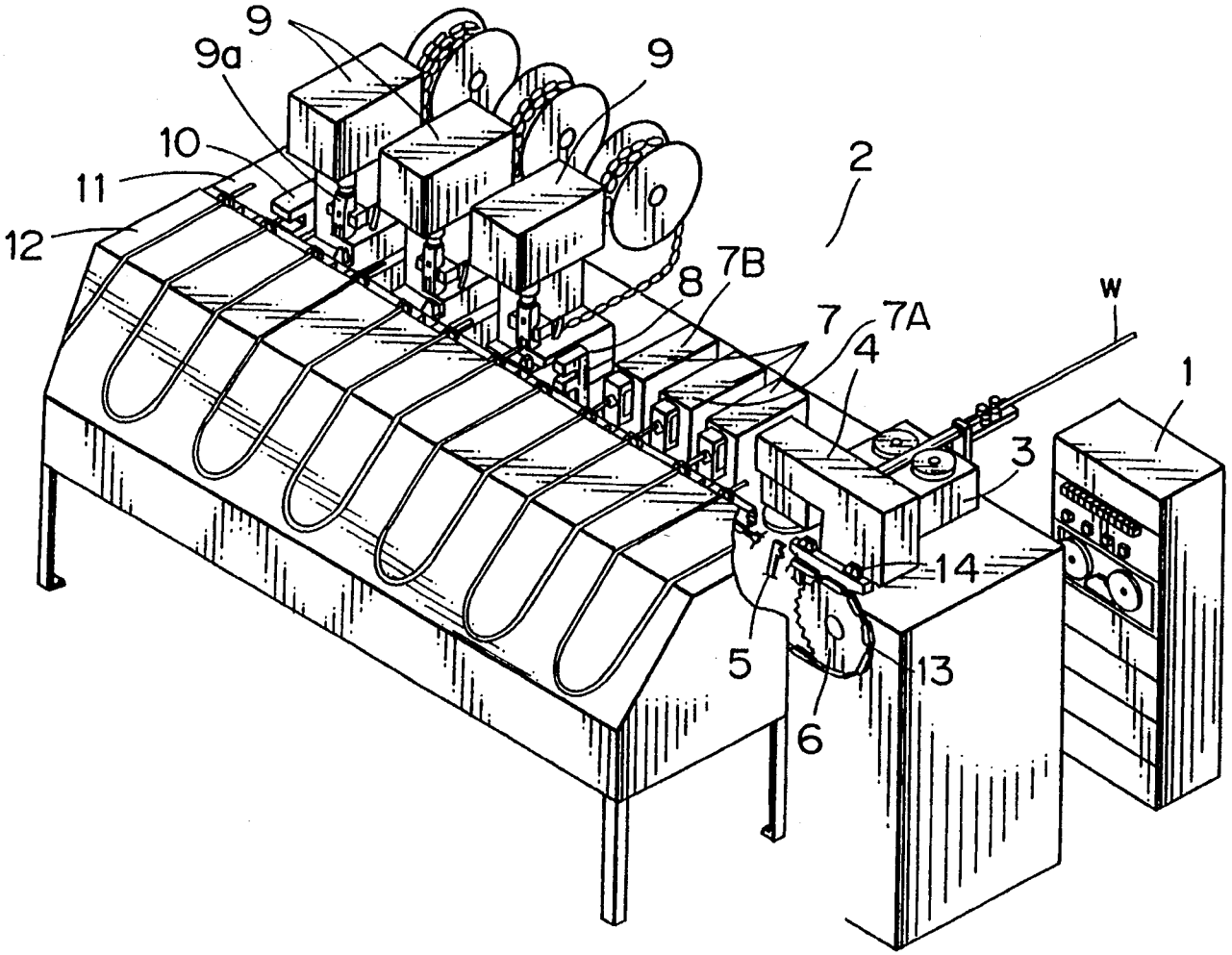
FIG. 7 PRIOR ART
FIG. 7 is a perspective view showing a conventional wire ends processing apparatus.

By the way, since functions of such devices as the automatic control device 21, the wire feed device 23, the cutting device 25, the conveyer device 26, the stripping device 27, and the sensor 28 are same as those of the conventional ones shown in FIG. 7, a detailed explanation thereabout is omitted here.

Figure 2:
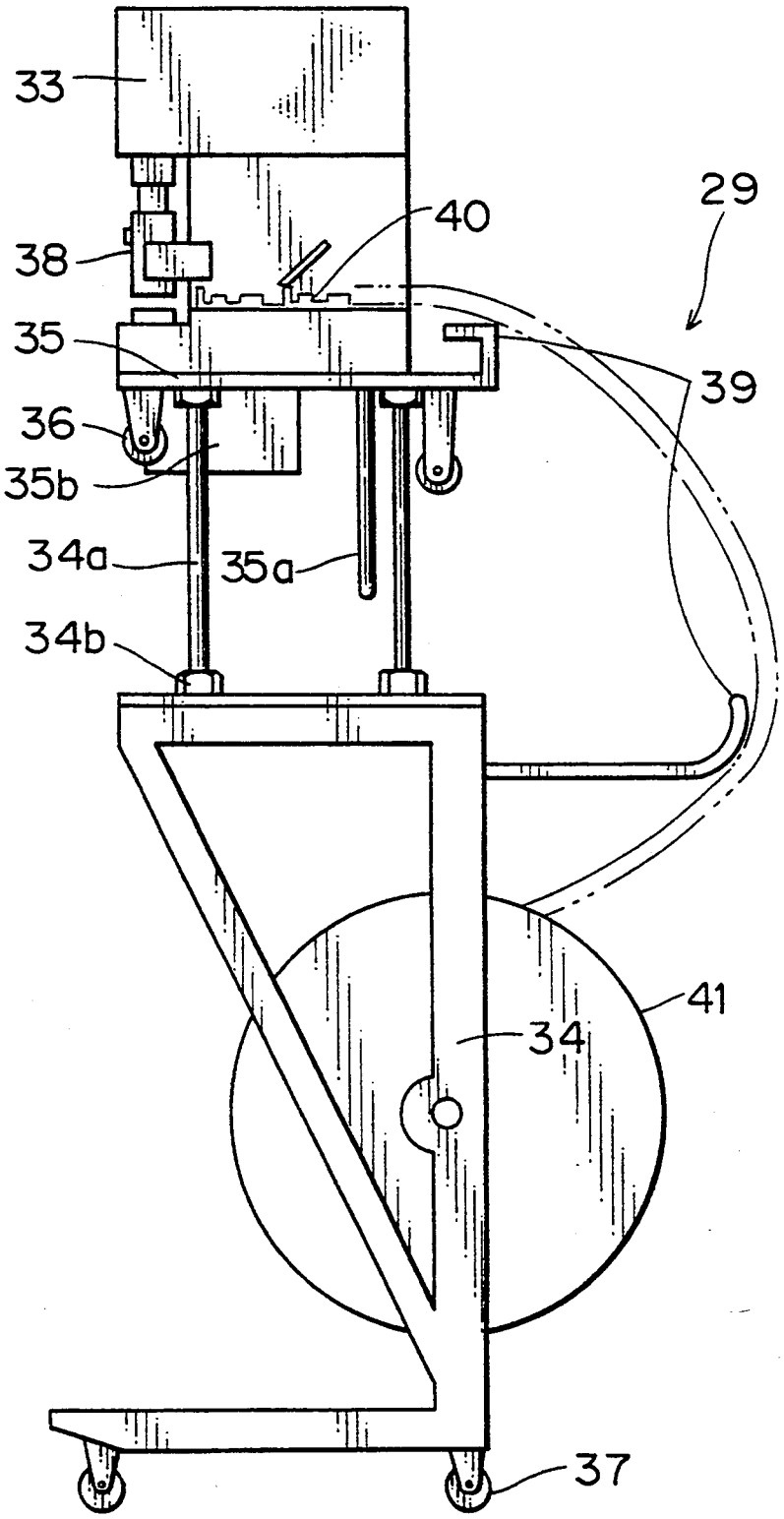
FIG. 2 is a side elevational view of the connector pressing unit of FIG. 1.

FIG. 2 is a side elevation of a connector pressing unit 29, which is composed of a connector pressing device 33 and a pedestal 34, and is adapted to press and clamp an electric connector member onto a naked conductor portion of the wire which moved past the sensor 28. In the figure reference numeral 35 denotes a base plate for the connector pressing device 33, and is provided with rollers 36 in each of the four corners of the back surface thereof, each of which is supported by a shaft, wherein an operation rod **35*a* is protrudedly provided downward from the rear center portion of the back surface, and a fin 35*b* is also protrudedly provided downward from the front portion of the back surface. The base plate 35 is supportedly connected with the pedestal 34 by way of four link shafts 34*a* mounted upwardly from the upper surface of the pedestal 34, and the pedestal itself is also provided with casters 37 at each of the four corners of the back surface of the bottom plate thereof. It is to be noted that each of the link shafts is provided with screwed portions at the uppermost and lowest ends thereof, whereby a distance between the base plate 35 and the pedestal 34 can be adjusted by nuts 34*b*. At the front portion of the back surface of the connector pressing device 33, an applicator 38 provided with a pressing mold (not shown) and a connector feeding assembly is attachedly mounted, wherein the applicator 38 is adapted such that a series of electric connectors 40 are fed thereto by being guided through connector guides 39 which are projectedly provided respectively from the rear ends of the base plate 35 and the pedestal 34. By the way, a series of plurality of electric connectors 40 are consecutively molded, and are reeled by a connector reel 41 axially attached to the pedestal 34**.

Figure 3:
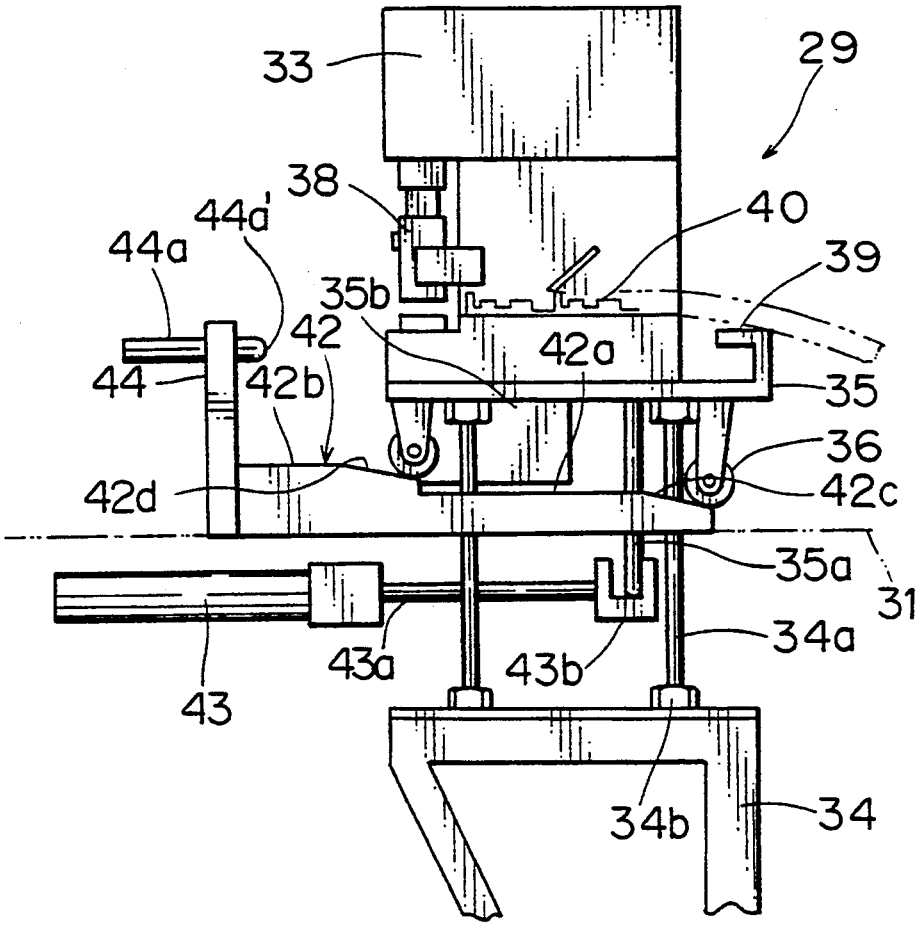
FIG. 3 is a side elevational view showing locations of the important parts just before the connector pressing unit is installed.

As shown in FIG. 3, a pair of guide rails 42 are protrudedly mounted in the lateral direction next to the location of a stripping device 27 on the platform 31 of the wire ends processing apparatus 22, and each of the rails 42 comprises not only horizontal portions **42*a*, 42*b* respectively at the center portion and front end portion thereof, but also comprises slant portions 42*c* and 42*d* respectively at the end portion thereof and at the position between the horizontal portions 42*a* and 42*b*. The width between the two guide rails 42, 42 is set substantially equal to that between two rollers 36 of the opposite rails. Inside the horizontal portion 42*b* of the pair of guide rails 42, 42, there is provided a U-shape guide groove (not shown) to be mated with a fin 35*b* of the base plate 35, and in the middle between the respective front end portions of the two guide rails, there is provided a stopper supporting plate 44 upright from the platform 31, and a screw-shaped stopper 44*a* is spirally inserted to the upper portion of the stopper supporting plate 44, wherein an end portion 44*a*' of the stopper 44*a* is abutted to the base plate 35 when the base plate 35** is in the set position thereof.

Reference numeral 43 denotes a retreatable cylinder which is located substantially at the lower center between the pair of guide rails 42, 42 and fixed to the platform 31. A piston rod 43*a* of the cylinder 43 is provided with a gripper 43*b* whose sectional surface is formed in U-shape, and the gripper 43*b* is mated with an end portion of the operation rod 35*a*. By the way, the stopper supporting plate 44, a pair of guide rails 42, 42, and cylinder 43 are all made in two sets, and the connector pressing unit 29 is made in three or more than three sets.

In the wire ends processing apparatus 22 as constructed above, various applicators 38, each of which is provided with individual mold and connector feeding assembly exclusive to each of different types of electric terminals 40, are installed to the connector pressing device 33, and also a connector pressing unit 29 is preliminarily provided in which a series of chained electric connectors 40 are reeled up around a connector reel 41.

An Operation of the connector pressing unit 29 will now be explained as below.

As shown in FIG. 3, pushing forward a connector pressing unit 29 provided with one type of electric connector, a pair of front rollers 36 of the base plate 35 are set on each end of the slant portion 42*d* of the respective guide rails, and a pair of rear rollers 36 on each end of the slant portion 42*c*. At this stage, as the gripper 43*b* of the piston rod 43*a* of the cylinder 43 is located just beside the lowest portion of the operation rod 35*a*, it is coupled with the lowest portion of the operation rod 35*a* by rotating it for an angle of 90 degree. Then, connecting a cord (not shown) of the connector pressing device 33 to the automatic control device 21, the power switch (not shown) of the connector pressing unit 29 is set to on. By this operation, the retreatable cylinder 43 is activated, the piston rod 43*a* is drawn, and the operation rod 35*a* is also drawn toward the platform 31 of the wire ends processing apparatus 22. Thus, the front pair of rollers 36 of the base plate 35 climb up the slant portion 42*d* of each of the guide rails 42, 42, and then the rear pair of rollers 36 also climb up the slant portion 42*c* of the respective guide rails.

Figure 4:
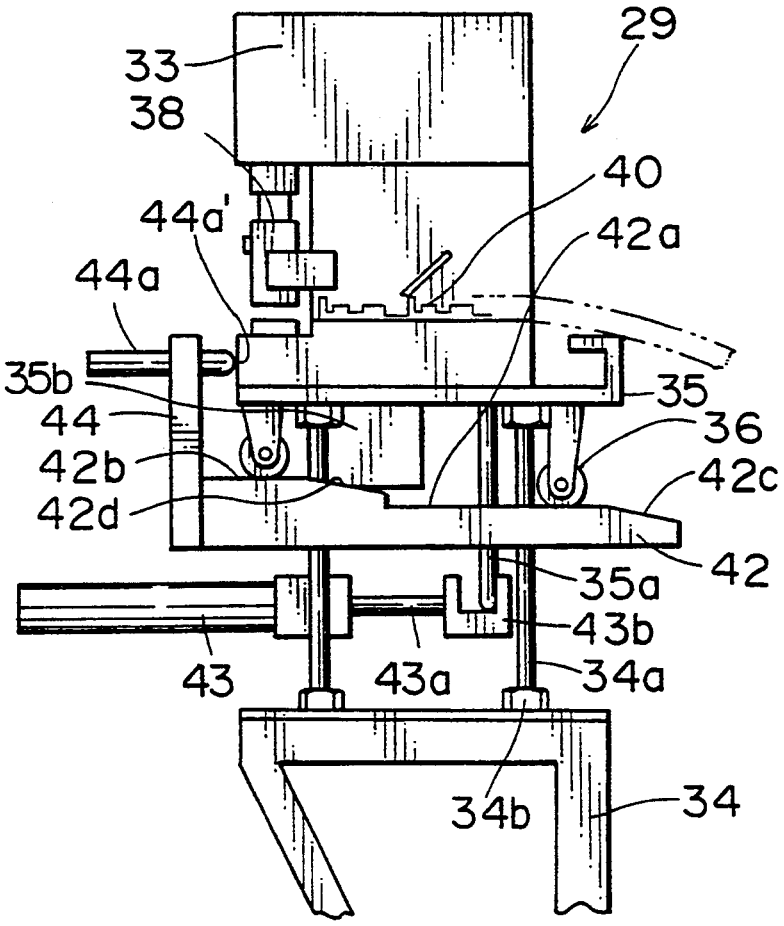
FIG. 4 is a side elevational view showing locations of the important parts when the connector pressing unit is already installed.

As a result, the front pair of rollers 36 of the base plate 35 are, as shown in FIG. 4, located on the horizontal portion 42*b* of each of the guide rails 42, and also the rear pair of rollers 36 are located on the horizontal portion 42*a*. Further, the front end of the base plate 35 is abutted to one end portion 44*a'* of the stopper 44*a* and settled at the correct set position thereof, wherein this position is maintained during the whole operation due to a drawing force of the piston rod 43*a* of the cylinder 43. By the way positioning of the base plate 35 of this case in the sideward direction is settled by the fact that the fin 35*b* is engaged with the before-mentioned guide groove (not shown).

As described heretofore, when the power switch of the automatic control device 21 of the wire end processing apparatus 22 is set to on, the wire W is cut to a predetermined length through a predetermined procedures, the wire end 35 is peeled off and fed to the stage of the connector pressing unit 29 as above in accordance with a predetermined tact, and then the electric connector 40 is pressed and clamped in accordance with a control signal from the automatic control device 21. It is, however, to be noted that although a plurality of pressing units 29 are normally provided to the wire ends processing apparatus 22 and being activated, there is an occasion that some of them are not in motion. In this occasion, by removing in advance the connector pressing unit 29 and replacing with another unit which is provided with another type of electric connector to be processed next and preadjusted, one can smoothly move to a production of wire harness with different type of electric connector even without stopping the operation of the whole wire ends processing apparatus 22. Thus, the apparatus of the present invention facilitates a high-speed production on many-kinds-and-small-amounts basis of wire harnesses.

Figure 5:
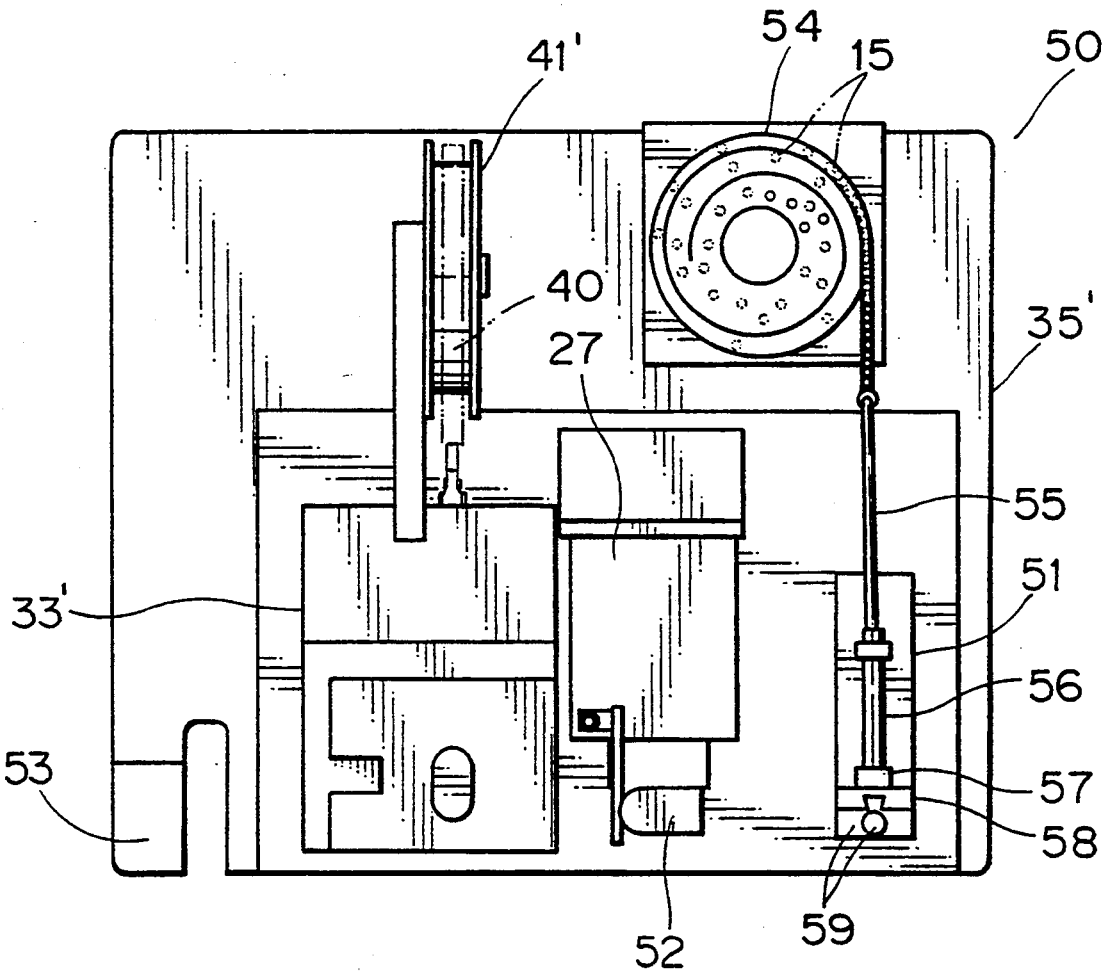
FIG. 5 is a plan view of a composite unit provided to the wire end processing apparatus according to a second aspect of the present invention.
Figure 8:
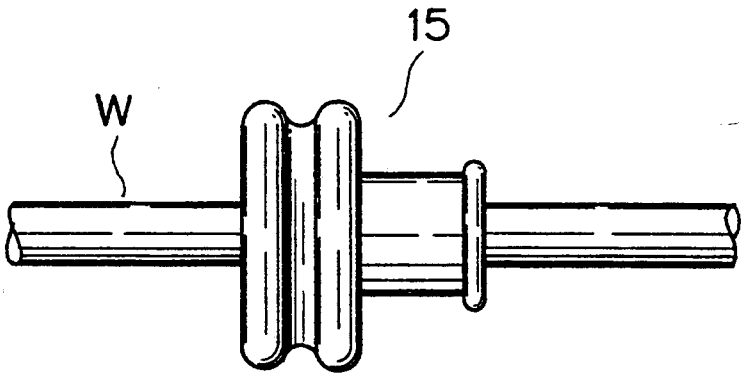
FIG. 8 is an explanatory view showing the rubber plug used for a water-proof connector.
Figure 6:
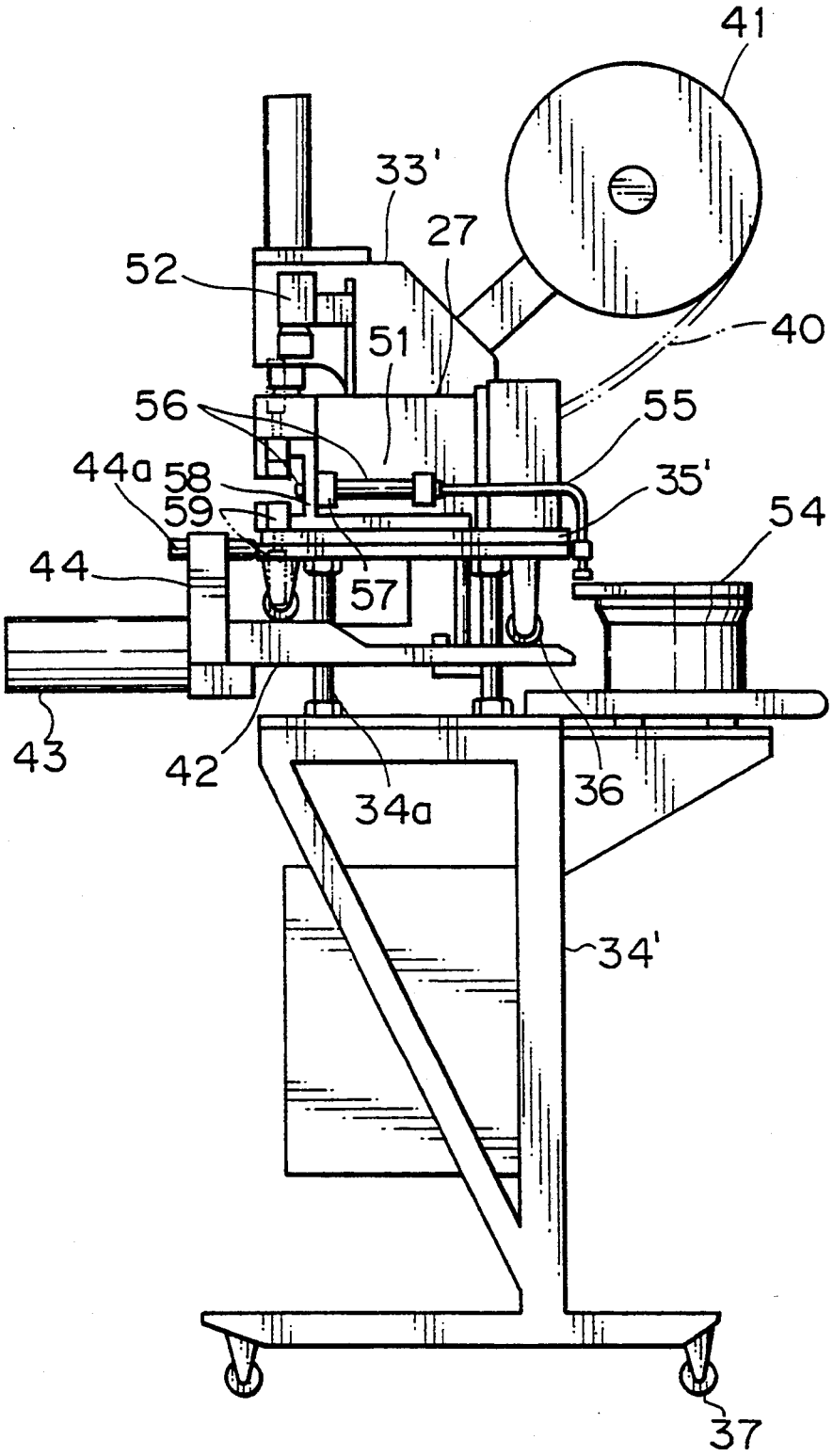
FIG. 6 a side elevational view of a rubber plug inserter of FIG. 5.

FIG. 5 is a plan view showing a composite unit of the present invention according to the second aspect, and FIG. 6 is a side elevational view thereof. It is to be noted that like or same numerals are put to the same members constituting the first embodiment of the present invention in order to omit a detailed explanation thereabout.

A composite unit 50 comprises, form right to left, a rubber plug inserter 51, a stripping device 27 and a connector pressing device 33' installed on the base plate 35' supported by the pedestal 34' just like the first embodiment of the invention, and reference numeral 52 denotes a sensor (as a monitor camera in the figure) for determining whether or not the uncovered condition of the wire is acceptable, and 53 denotes a sensor for judging the clamped condition of the connector on the wire.

For a rubber plug 51, one having the same structure as the conventional stripping device 27 can be used. For example, the rubber plug inserter 51 is composed of parts feeder 54, a guide nozzle 56 and a wire gripper 59 (Japanese Patent Application Laid-Open No. 2-75181). The parts feeder 54 feeds the rubber plugs one by one in the same direction, and the guide nozzle 56 receives each of the plugs and also receiving air supply in the axially movable mode. Further, the wire gripper 59 aligns the axis of the stripped end of the wire with that of the guide nozzle 56, and simultaneously grips the wire end in such a manner that it faces to an open inlet of the nozzle. Reference numeral 55 is a hose for conveying the rubber plug to the guide nozzle 56, and 57 denotes a cylinder for the guide nozzle, and also denoted by 58 is a frame for supporting the guide nozzle 56 by way of the cylinder 57. It is to be noted that here a terminal reel 41' is installed to the connector pressing device 33' instead of being axially supported by the pedestal 34'.

Insertion of the rubber plug is performed by the following procedure, First, gripping the wire with its end protruded by the linear-form wire gripper 59, axially aligning it with the guide nozzle 56 to face the open inlet thereof, pushing the guide nozzle 56 forward in order for the wire end to enter therein, preparing the rubber plug to the guide nozzle 56 and pressuring the air to the wire end to transfer it inside the nozzle, and finally firmly fixing the rubber plug to the end portion of the above prepared wire.

As explained above, by forming a composite unit 50 having the rubber plug inserter 51 and the stripping device 27 other than the connector pressing device 33', the clamping operation of a specific type of electric connector and installation and replacement of a rubber plug exclusively used for the connector can be performed at high-speed. It is also to be noted that the rubber plug inserter is not limited to the above construction, and it goes without saying that various types of inserters can also be adopted.

[Effect of the Invention]

As explained heretofore, in an apparatus that prepares wires necessary for electric wiring by measuring and cutting a length of a wire fed from a wire paying-out device, conveying the cut length of wire in a direction perpendicular to the axial direction of the paid-out wire, stripping wire end portions, and pressing an electric connector, since the present invention according to the first aspect provides a configuration in which a plurality of connector pressing units can be selectively mounted to cope with various types of connectors, whereby many-kind, small-amount production by shortening a programming time for a lot change while eliminating mechanical adjustment caused by the programming.

Besides, since the present invention according to the second aspect provides a configuration in which a composite unit composed of a rubber plug inserter, an insulating cover stripping device, and a connector pressing device is installed, whereby insertion of the rubber plug exclusively used for one type of electric connector and to be settled concurrently with the settlement of the composite unit, whereby it can cope speedily with a current trend of a small-amount, many-kind production system.

Having now fully described the invention, it will be apparent to one of ordinary skill in the art that many changes and modifications can be made thereto without departing from the spirit and scope of the invention as set forth herein.

What is claimed is:

1. A wire ends processing apparatus for preparing wires necessary for electric wiring comprising;

a wire feed device, a reversing device for clamping an end portion of the fed wire and rotating along the paid-out direction of wire to reverse in a hair-pin configuration, a cutting device for cutting off a predetermined length of the wire fed in relation with the action of the wire feed device and said reversing device, a conveyer device for transferring the wire cut off by the cutting device, a stripping device for removing the insulating cover from the end portion of the wire brought thereto by the conveyer device and a platform for mounting said devices, wherein said wire ends processing apparatus further comprises;

a plurality of replaceable connector pressing means located next to said stripping device, each of said connector pressing means being composed of a connector pressing device and a pedestal for supporting said pressing device, wherein said connector pressing device is provided with an applicator composed of a pressing mold and a connector feeding assembly for receiving a series of electric connectors, and mounted on a base plate having rollers on the back surface thereof to be movable on a pair of guide rails provided on said platform, and said pedestal is provided with casters on the back surface of the bottom plate thereof, and is connected to the back surface of said base plate by way of a plurality of link shafts provided upwardly from the upper plate of said pedestal.

2. A wire ends processing apparatus as claimed in claim 1, wherein each of said link shafts is formed with screwed portions at the uppermost and lowest ends thereof to enable adjustment of distance between said base plate and said pedestal by nuts.

3. A wire ends processing apparatus as claimed in claim 1, wherein said base plate is further provided with an operation rod for activating said connector pressing device on said guide rails by way of a gripper which is attached to a piston rod of a retreatable cylinder, said retreatable cylinder being located substantially at the lower center of said pair of guide rails and fixed to said platform.

4. A wire ends processing apparatus as claimed in claim 1, wherein said striping device is further included on said pedestal of each of said replaceable connector pressing means, said replacement connector means further comprising a rubber plug inserter before said stripping device for attaching a rubber plug to each of the wires brought thereto.

* * * * *